US005388415A

United States Patent [19]

Glinka et al.

[11] Patent Number: 5,388,415

[45] Date of Patent: Feb. 14, 1995

[54] SYSTEM FOR A COOLER AND GAS PURITY TESTER

[75] Inventors: Ofer Glinka, Kiryat-Motzkin; Shmuel Segev, Haifa; Ariel Trau, Naharya, all of Israel

[73] Assignee: State of Israel - Ministry of Defence Armament Development Authority, Rafael, Haifa, Israel

[21] Appl. No.: 177,726

[22] Filed: Jan. 5, 1994

[30] Foreign Application Priority Data

Jan. 24, 1993 [IL] Israel ..... 104,496

[51] Int. Cl.[6] ..... F25B 47/00; F25B 19/00

[52] U.S. Cl. ..... 62/51.2; 62/52.1; 62/196.1; 62/197

[58] Field of Search ..... 62/51.1, 51.2, 52.1, 62/196.1, 197

[56] References Cited

U.S. PATENT DOCUMENTS

| | | | |
|---|---|---|---|
| 2,943,459 | 7/1960 | Rind | 62/217 |
| 3,314,473 | 4/1967 | Smith et al. | 62/51.2 |
| 3,933,003 | 1/1976 | Markum | 62/51.2 |

OTHER PUBLICATIONS

*Miniature Refrigerators for Cryogenic Sensors and Cold Electronics*, by Graham Walker, Oxford University Press, pp. 12–82, New York, 1989.

*Primary Examiner*—Albert W. Davis, Jr.
*Attorney, Agent, or Firm*—Morgan & Finnegan

[57] ABSTRACT

A system for a cooler comprises: a heat exchange tube receiving a supply of pressurized gas, a gas escape aperture communicating with the interior of the heat exchange tube for permitting escape of the pressurized gas and expansion thereof during cooling mode, and a bypass assembly associated with said heat exchange tube and located after said gas escape aperture which during a cleaning mode enables most of the pressurized gas to exit the heat exchange tube without flowing through said gas escape aperture. The bypass assembly comprises a flush valve which is closed during said cooling mode and which is opened during said cleaning mode. According to a preferred embodiment, the heat exchange tube is helically wound over a cylindrical core and installed inside an insulated housing. The system may also be utilized as a gas purity tester, optionally with an additional gas pressure regulator, wherein a sensor will indicate the extent of the gas purity.

10 Claims, 2 Drawing Sheets

SYSTEM FOR A COOLER AND GAS PURITY TESTER

The present invention relates generally to a system to be useful as a cryogenic cooler and more specifically to cleaning of such a cooler as well as a gas purity tester.

BACKGROUND OF THE INVENTION

Gas decompression coolers, such as Joule-Thomson coolers, utilize the fact that a gas undergoing adiabatic expansion will be cooled. In such coolers, compressed gas is continuously fed into a tube which has a small aperture in it. The gas which escapes through the small aperture cools through its rapid expansion and exchanges heat with the incoming gas, thus partially cooling the incoming gas.

Joule-Thomson coolers are described in detail in the book *Miniature Refrigerators for Cryogenic Sensors and Cold Electronics,* written by Graham Walker and published by Oxford University Press, New York, 1989.

Due to the low temperature achieved at the aperture, impurities found in the gas accrete in the form of liquid drops or solids deposited over the interior of the tube near the aperture and/or within the aperture itself. This can cause partial or complete stoppage of the flow of the gas.

Under prevailing practices, in cases of light contamination, the operation of the cooler must be stopped, the cooler must be allowed to warm up, which takes approximately one-half hour, and then the cooler must be flushed with pure gas.

In cases of extreme contamination, the tube must be dismantled prior to its flushing with a cleaning liquid. The cleaning process is cumbersome and lengthy, typically taking a few hours.

As well-known in the art, some prior coolers are also utilized as gas purity testers, testing the purity of the gas by the amount of contaminants accumulated during a "test". At the start of each test, the cooler must be at a starting temperature which is typically considerably higher than the operating temperature to which the cooler is brought during a test. Thus, at the end of any test, a prior art cooler must be returned to its starting temperature, a process which typically takes again about 30 minutes.

It is an object of the present invention to provide a system capable to be used as a cooler which comprises improved means of expelling contaminants which accumulate inside a heat exchange tube and the aperture of the gas decompression cooler, such as a Joule-Thomson cryogenic cooler and/or a gas purity tester.

It is a further object of the present invention to provide an improved cooler comprising a cleaning system which does not require dismantling of the heat exchange tube and whose cleaning and warm-up periods are much shorter than those of the prior art.

BRIEF DESCRIPTION OF THE INVENTION

In accordance with a preferred embodiment of the present invention, the system for a cooler will include: (a) a heat exchange tube receiving a supply of pressurized gas; (b) a gas escape aperture communicating with the interior of the heat exchange tube for permitting escape of the pressurized gas and expansion thereof during a cooling mode, and (c) a by-pass assembly, associated with the heat exchange tube and located after the gas escape aperture, which during a cleaning mode, enables most of the pressurized gas to exit the heat exchange tube without flowing through the gas escape aperture, and (d) a sensing apparatus for indicating the extent of the gas purity, wherein a prolonged continuous operating time indicates a more pure gas. Optionally, a pressure regulator may be added in order to ensure a better reproducibility and accuracy of the purity test.

DETAILED DESCRIPTION OF THE PREFERRED EMBODIMENTS

In accordance with a preferred embodiment of the present invention, the bypass assembly comprises a flush valve which is closed during the cooling mode and which is opened during the cleaning mode. In this manner, during a cleaning cycle, high velocity gas is forced to pass through the tube and flush out the contaminants.

Moreover, in accordance with a preferred embodiment of the present invention, the heat exchange tube is helically wound over a cylindrical core and installed inside an insulated housing (dewar). The by-pass assembly is formed of an extension to the heat exchange tube inside the cylindrical core. Further, in accordance with the preferred embodiment of the invention, during the cooling mode, the gas escapes through the gas escape aperture to the housing, thereby cooling the heat exchange tube and the warm gas flowing in until liquefaction occurs. During the cleaning mode, the gas generally bypasses the gas escape aperture, thereby the warm gas flowing in warms the heat exchange tube.

Still further, in accordance with a preferred embodiment of the present invention, the cooler includes a sensor which preferably controls apparatus for switching the cooler from the cooling mode to the cleaning mode. The sensor may be a flow measuring apparatus responsive to the quantity of gas flowing through the gas escape aperture or a temperature sensing element, such as thermocouple, located at the vicinity of the gas escape aperture. Moreover, in accordance with a preferred embodiment of the present invention, the cooler is characterized in that the cleaning mode raises a temperature of the cooler to a desired temperature.

There is also provided, in accordance with a preferred embodiment of the present invention, a gas purity tester including (a) a heat exchange tube receiving a supply of pressurized gas, (b) a gas escape aperture communicating with the interior of the heat exchange tube for permitting escape of the pressurized gas and expansion thereof during a cooling mode, (c) a by-pass assembly, associated with the heat exchange tube and located after the gas escape aperture, which during a cleaning mode, enables most of the pressurized gas to exit the heat exchange tube without flowing through the gas escape aperture, and (d) a sensor apparatus indicating the extent of the gas purity, according to the quantity of gas flowing through the gas escape aperture or to the coolers temperature. A prolonged operating time will indicate a more pure gas. Optionally, a gas pressure regulator is also installed in order to obtain more reliable results.

BRIEF DESCRIPTION OF THE DRAWINGS

The present invention will be understood and appreciated from the following detailed description taken in conjunction with the drawing in which.

Figure 1B:
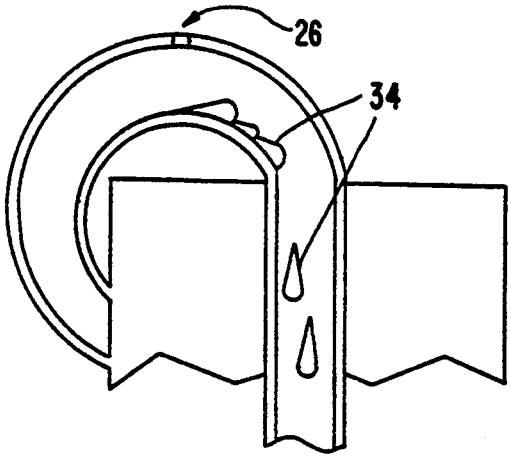
FIG. 1B is a detailed illustration of an aperture section of the cooler shown in FIG. 1A in accordance with a preferred embodiment of the invention.
Figure 1A:
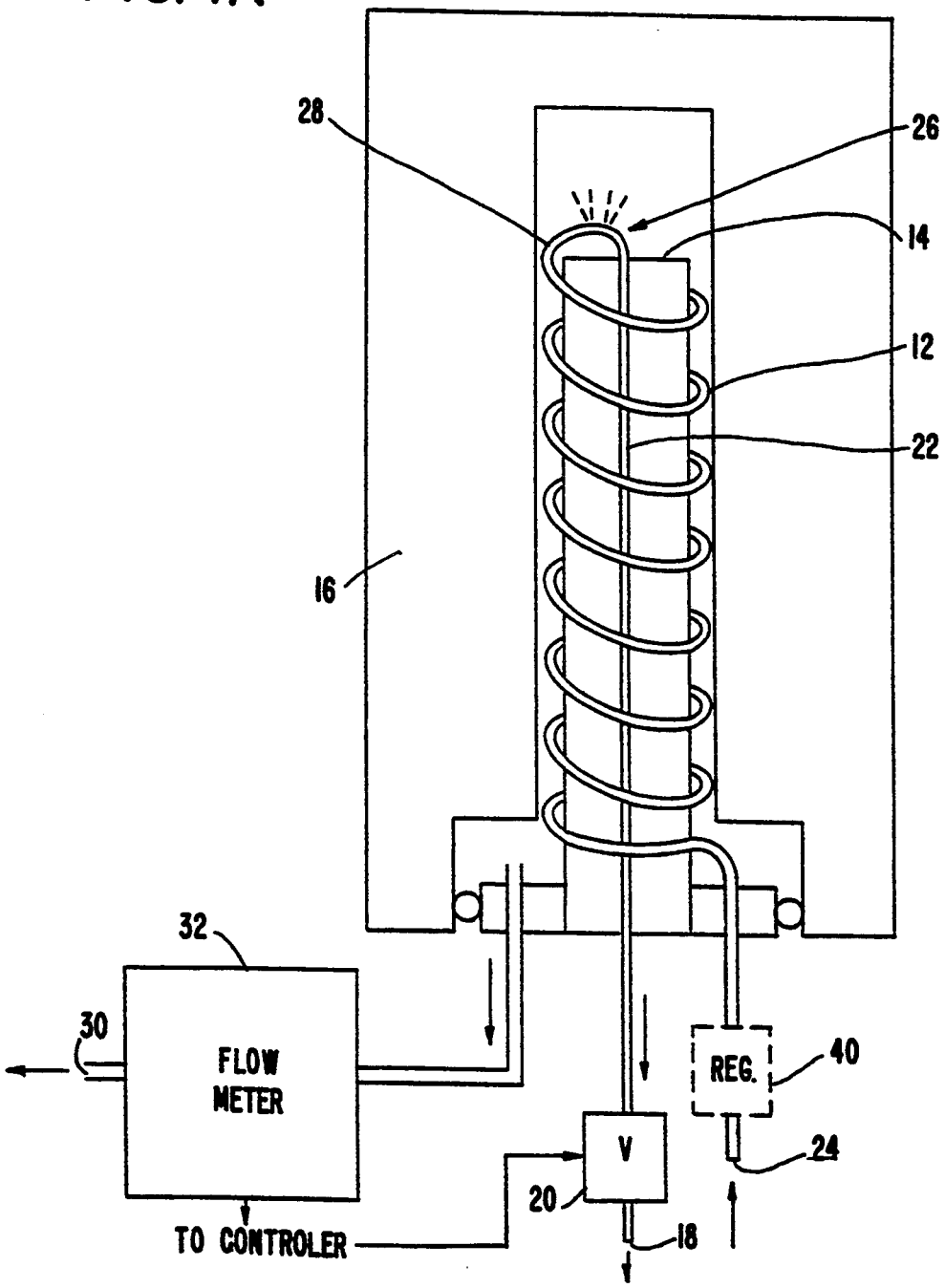
FIG. 1A is a schematic illustration of a typical Joule-Thomson cryogenic cooler with a downstream continuation in accordance with a preferred embodiment of the invention.

Reference is now made to FIGS. 1A and 1B which illustrate a cryogenic cooler constructed and operative in accordance with a preferred embodiment of the invention. As an example only, the cooler shown in FIGS. 1A and 1B is of the Joule-Thomson type. As known in the art, this type of cooler can be utilized as a gas purity tester. As in the prior art, the cooler typically comprises a heat exchange tube 12 wrapped around a core 14, both of which are located within a housing 16. In accordance with the present invention, tube 12 is extended out of the housing 16 and ends in an exit 18 to which is attached a high pressure valve 20. The extension of tube 12 is referenced herein 22.

The tube 12 can be of any appropriate diameter, such as 0.3 mm inner diameter and 0.5 mm outer diameter.

During operation, a highly pressurized gas, such as Nitrogen, Oxygen, Argon and any other suitable gas, is fed into heat exchange tube 12 at an entrance 24. During a cooling mode, valve 20 is maintained in a closed position and gas escapes through a small aperture 26 in tube 12 at a section 28 near the non-valve end of extension 22. Aperture 26 can be of any suitable size to effect cooling. For example, for the tube size given hereinabove, aperture 26 preferably has a diameter between 0.04 and 0.06 mm. The gas is typically at a pressure between 1500 and 6000 psi.

Cooling is effected when the highly pressurized gas escapes to the low pressure inside the housing 16, after having exchanged heat with the high pressure gas. The low pressure gas exits through an exit 30 before which is located a flow rate meter 32 for measuring the flow through exit 30.

Due to the decompression and cooling of the gas in the cooling mode described above, contaminants contained in the high pressure gas accumulate inside tube 12, near or inside aperture 26, in the form of liquid or solid accumulations 34.

In a preferred embodiment of the invention, a cleaning mode is provided for removing the accumulations 34. In this cleaning mode, which typically occurs immediately after the cooling mode, high pressure valve 20 is opened, either manually or automatically, and the high pressure gas is allowed to exit through exit 18.

Due to the pressure differential between the high pressure at the entrance 24 and the outside pressure at exit 18, most of the gas passes at high velocity through tube 12, carrying with it accumulations 34.

Typically, the cleaning mode lasts for about 2 minutes, during which time the high pressure gas is continuously fed through tube 12. Because very little gas exits through aperture 26, very little cooling occurs. The little gas which does exit the aperture 26 serves to clean the aperture and the gas which flows by the aperture 26 serves to warm and clean the tube 12 in the area of the aperture. It is noted that the warmer the tube 12 is, the more easily the contaminants flow.

Due to the movement of the warm gas through the tube 12, the cleaning mode typically rapidly returns the cooler to near the room temperature, the typical starting temperature suitable for restarting of the cooling operation. This is in contrast to the prior art which requires a significant amount of time to return to the starting temperature.

It will be appreciated that the apparatus described herein allows for a relatively rapid flushing of contaminants found in the gas as well as a relatively rapid returning of the cooler to its starting temperature.

It will further be appreciated by those skilled in the art that the present invention encompases a valve 20 located anywhere after the aperture 26.

Furthermore, any device which enables gas to flow through the cooler generally without performing the cooling and heat exchanging operation is included within the present invention.

In a preferred embodiment of the invention, the flow meter 32 provides flow rate information to a controller (not shown). The controller is typically programed to switch the cooler to the cleaning mode when the flow rate is reduced to under a predetermined rate, such as 20% less than a desired rate, or a change in the gas quality is involved. The controller switches the modes of the cooler by selectively opening (for the cleaning mode) and closing (for the cooling mode) valve 20.

Figure 2:
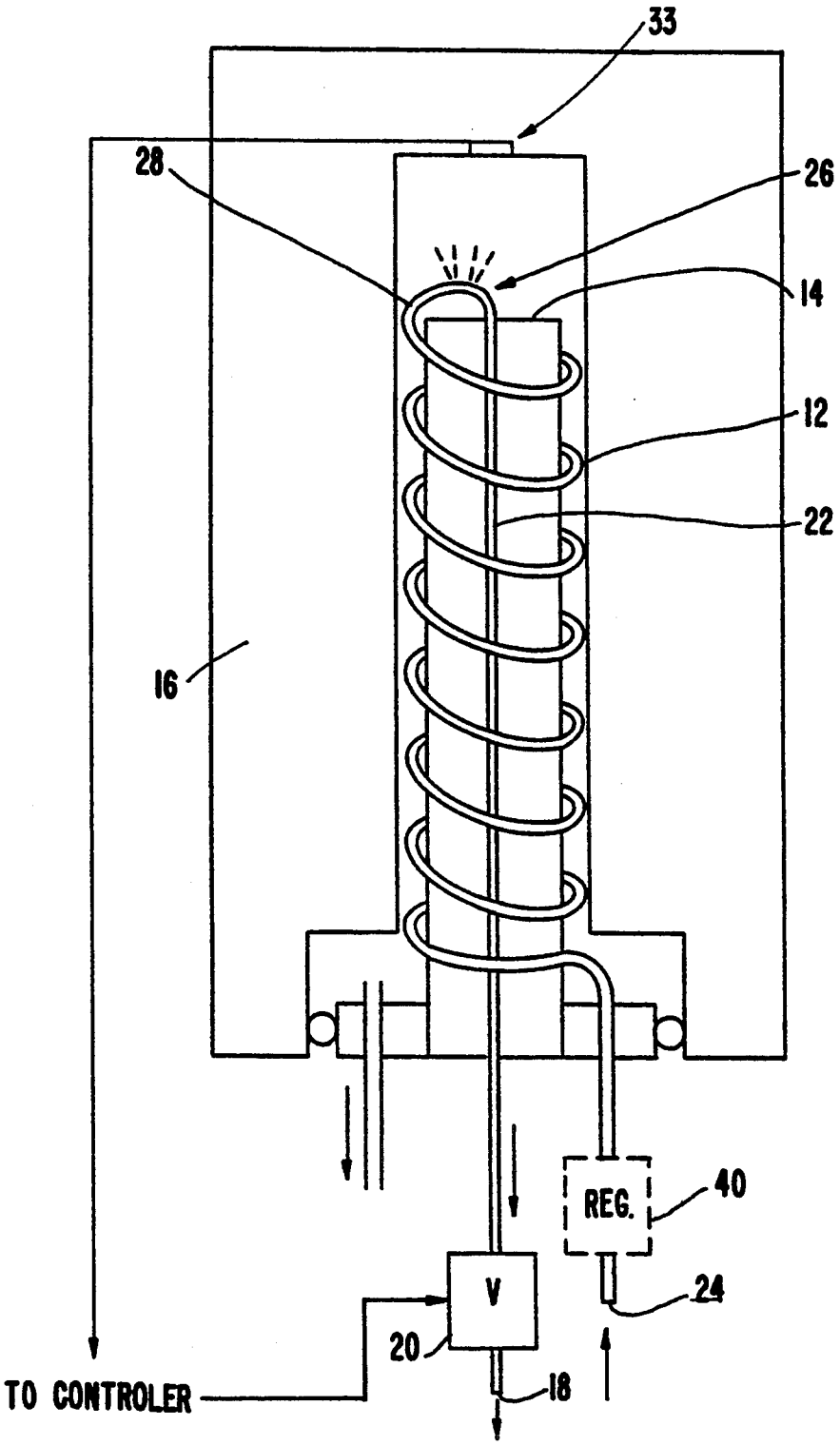
FIG. 2 is a schematic illustration of a typical Joule-Thomson cryogenic cooler with a temperature sensor in accordance with a preferred embodiment of the invention.

Alternatively, as shown in FIG. 2, a temperature sensor 33, such as a thermocouple, may be located at the vicinity of the gas escape aperture and providing temperature information to the controller. As cooling stops due to blockage of the aperture by contaminants, the temperature rises. The controller is typically programmed to switch the cooler to the cleaning mode at a predetermined temperature value.

In accordance with an additional embodiment of the present invention, a pressure regulator 40 can be included just after entrance 24. The pressure regulator 40 ensures a steady pressure and, as a result, ensures that the type of stoppage achieved is repeatable for each pressure level.

It will be appreciated that the length of the cleaning mode depends on the size of the tubes, the extent to which the system needs to be heated and the minimum loss of gas, during cleaning, allowable.

It is a feature of the present invention that the flushing mechanism is an integral part of the cooler and enables cleaning of the heat exchange tube without dismantling the cooler.

As well known in the art, the system based on a Joule-Thomson cryogenic cooler, is most suitable for a gas purity tester. Using the system according to the present invention, the gas purity tester will comprise: (a) a heat exchange tube receiving a supply of pressurized gas; (b) a gas escape aperture communicating with the interior of the heat exchange tube for permitting escape of the pressurized gas and expansion thereof during a cooling mode; (c) a by-pass assembly, associated with said heat exchange tube which is substantially enclosed in a housing and located after said gas escape aperture, wherein during a cleaning mode gas escapes through said escape aperture into said housing, and (d) a sensor for indicating the extent of the gas purity wherein a longer continuous operating time indicates a purer gas. Optionally, a pressure regulator at the gas inlet is installed in order to ensure a better reproducibility and accuracy of the purity test of the respective gas.

It will be appreciated by persons skilled in the art that the present invention is not limited by the description provided hereinabove. Rather, the scope of this invention is defined only by the appended claims.

We claim:

1. A system for a cooler comprising:

a heat exchange tube receiving a supply of pressurized gas;

a gas escape aperture communicating with the interior of the heat exchange tube for permitting escape of the pressurized gas and expansion thereof during a cooling mode; and a bypass assembly, associated with said heat exchange tube and located after said gas escape aperture, which during a cleaning mode, enables most of the pressurized gas to exit the heat exchange tube without flowing through said gas escape aperture.

2. The system according to claim 1, wherein in the cooler said bypass assembly comprises a flush valve which is closed during said cooling mode and which is opened during said cleaning mode.

3. The system according to claim 1 wherein said cooler is installed in a housing comprising most of said heat exchange tube and wherein said bypass assembly is formed of an extension of said heat exchange tube outside of said housing.

4. The system according to claim 3, wherein during said cooling mode, gas escapes through said gas escape aperture to said housing, thereby to cool said gas which, in turn, cools said heat exchange tube and wherein, during said cleaning mode, said gas generally bypasses said gas escape aperture, thereby warming said heat exchange tube.

5. The system according to claim 1, including sensing means responsive to the quantity of gas flowing through the gas escape aperture.

6. The system according to claim 5, and wherein said gas flow measuring means include means for switching the cooler from the cooling mode to the cleaning mode at a predetermined gas flow rate.

7. The system according to claim 1, including means responsive to the cooler's temperature.

8. The system according to claim 1, characterized in that the cleaning mode raises a temperature of said apparatus to a desired temperature.

9. The system according to claim 1 and also including a pressure regulator.

10. The system for a gas purity tester comprising:

a heat exchange tube receiving a supply of pressurized gas;

a gas escape aperture communicating with the interior of the heat exchange tube for permitting escape of the pressurized gas and expansion thereof during a cooling mode;

a bypass assembly, associated with said heat exchange tube which is substantially enclosed in a housing and located after said gas escape aperture, wherein during a cleaning mode, gas escapes through said escape aperture to said housing; and sensing means for indicating the extent of the gas purity according to the respective time of a stable cooling operation.

* * * * *